US006149007A

United States Patent [19]

Yeh et al.

[11] Patent Number: 6,149,007

[45] Date of Patent: Nov. 21, 2000

[54] CENTRAL HANDLED CO-EXTRUDED STIFF POLYETHYLENE BAG STACK AND METHOD OF MAKING SAME

[75] Inventors: Ron C. Yeh, Morganville; Ben Tseng, East Brunswick, both of N.J.; Andy Cyrkin, Lolita, Tex.

[73] Assignee: Inteplast Group, Ltd., Livingston, N.J.

[21] Appl. No.: 09/431,026

[22] Filed: Oct. 27, 1999

[51] Int. Cl.[7] ..... B65D 33/14

[52] U.S. Cl. ..... 206/554; 383/10

[58] Field of Search ..... 383/7–10, 107, 383/109, 113; 206/554, 459.5; 493/187, 194

[56] References Cited

U.S. PATENT DOCUMENTS

| | | | |
|---|---|---|---|
| 4,216,899 | 8/1980 | Kamp | 383/10 |
| 4,346,834 | 8/1982 | Mazumdar | 383/8 |
| 4,367,841 | 1/1983 | Mazumdar | 383/8 |
| 4,636,412 | 1/1987 | Field | 383/113 |
| 4,943,167 | 7/1990 | Gelbard | 383/107 |
| 5,335,788 | 8/1994 | Beasley et al. | 206/554 |
| 5,469,969 | 11/1995 | Huang | 206/554 |
| 5,957,583 | 9/1999 | DeClements, Jr. et al. | 383/10 |

*Primary Examiner*—Jim Foster

*Attorney, Agent, or Firm*—William H. Pavitt, Jr.; Natan Esptein; David A. Belasco

[57] ABSTRACT

A pack of plastic shopping bags, each being in a rectangular configuration with a central opening below the upper edge to serve as both a means for mounting with other members of the pack on a forwardly and upwardly projecting support arm, and as a handle for the bag when removed from the support arm; and a method for making such bag packs to provide a stiff inner wall and a tacky outer wall for each bag, by co-extruding HMW HDPE of suggested ranges of density and melt index in a specified percentage of the total bag wall thickness with MLDPE of suggested ranges of density and melt index in the complementary percentage of the total wall thickness. The co-extruded tubing is flattened, subjected to corona treatment, may then receive printing and be gusseted, and thereafter cut transversely, sealed at one end of each cut blank, stacked and subjected to a die operation to cut the openings in all stacked blanks.

6 Claims, 3 Drawing Sheets

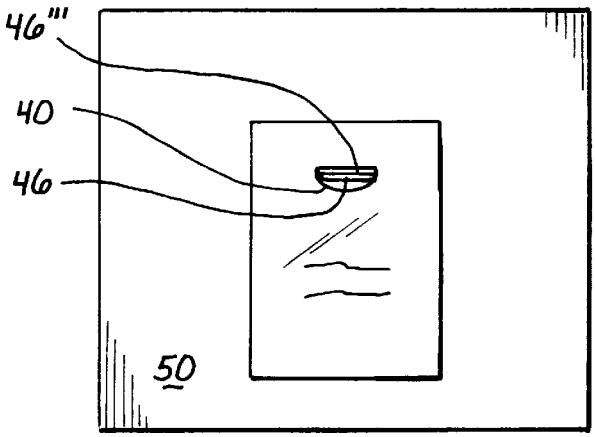
Fig. 6
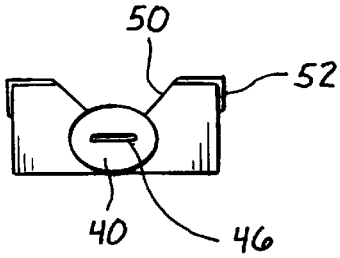
Fig. 7
Fig. 9
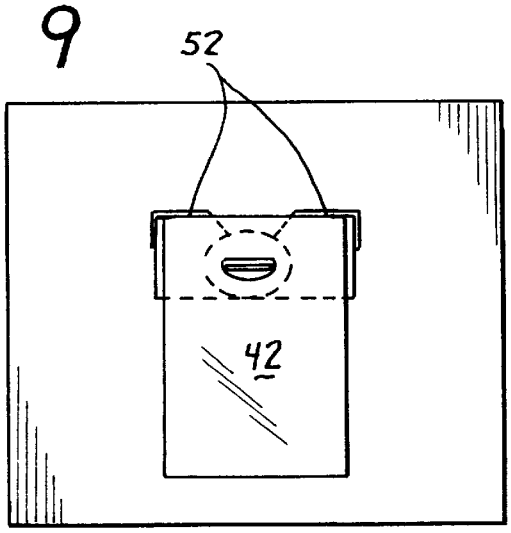
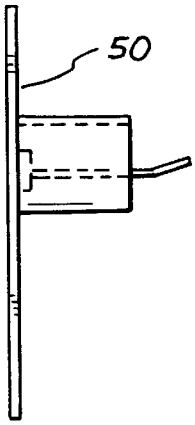
Fig. 8

CENTRAL HANDLED CO-EXTRUDED STIFF POLYETHYLENE BAG STACK AND METHOD OF MAKING SAME

FIELD OF THE INVENTION

This invention relates to the field of plastic shopping bags of a type which differ from the most common type of such bags, namely, those denominated T-shirt bags.

BACKGROUND OF THE INVENTION AND A DESCRIPTION OF THE PRIOR ART

Numerous types of plastic shopping bags have been developed and marketed particularly since the 1980's. The most common of such shopping bags which are in use today are fabricated by extruding tubing of a material such as high density polyethylene which may be flattened, gusseted, cut to desired lengths, sealed at the ends of such lengths and then subjected to die-cutting near one end of the rectangular sealed tubing lengths to produce bags each having a mouth defined by a pair of side handles. Because they somewhat resemble T-shirts, they have been and are currently referred to as "T-shirt bags." Customarily, they are delivered in packs of from 50 to 150 bags packed flat, one upon another. The walls of the bags are usually quite thin, but they have sufficient strength to hold articles weighing at least ten pounds.

Customarily, such T-shirt bags, when dispensed, are mounted on racks having a pair of arms spaced from each other which may be extended through some type of orifice in each of the registering arms of the T-shirt bags in the pack.

Because of the fact that when the bags are suspended on forward protruding rods extending through their respective bag arms, the bags tend to sag in the middle. Consequently, bag dispensing racks are often provided with a central mounting tab which is orificed to permit such element to be looped over some type of forwardly and upwardly projecting member.

It has also been a feature of such prior art bags to be made self-opening in the sense that as the first bag is pulled off the rack, the rear wall of the first bag is sufficiently adhered to the front wall of the next ensuing bag so that, as such rear wall is brought forward on the rack, it will pull the front wall of the next ensuing bag to open it, until sufficient force detaches the rear wall of the leading bag from the front wall of the next ensuing bag. Such adherence may be accomplished by glue, cold staking, and/or corona treatment of the outside walls of the bag, together with pressure points extending transversely through stacks of the bags.

In addition, provision has been made on occasion for fabricating bags by co-extrusion of different types of polyethylene, e.g. high density polyethylene for an inner bag layer and low density polyethylene for the outer layer. As a consequence, such bags may be provided with a degree of stiffness as well as of stickiness for the outer bag walls.

In use, after T-shirt bags are removed from their mounting rods and the intermediate hooking element, the user must insert his or her hand through each of the bag handles in order to carry the bag with whatever articles may have been placed in it. Because the bags are normally very thin, the handles tend to become rope like from the downward force occasioned by the weight of articles placed in the bag, with a tendency to place stress on the carrying hand.

While in some instances this has been sought to be remedied by providing a central handle hole through bag walls—not, however, in T-shirt type bags, but in bags which may be mounted at their corners such as is shown in U.S. Pat. Nos. 5,487,884, 4,7597,639, 5,248,040 and 4,903,839. In these patents, the bags are mounted on projecting arms of a rack at the corners of the bags which are detachable upon removing the bags on the rack arms.

SUMMARY OF THE INVENTION

The present invention provides a pack of rectangular polyethylene bags each of which has a substantially greater degree of stiffness than conventional T-shirt bags, and is mounted on a single projecting element having a flat upper surface of a predetermined width. The bags themselves are provided with central semi-lunar openings having a diameter slightly in excess of the predetermined width of the mounting element so that the bag rack may be mounted on, and dispensed from, that element. This semi-lunar opening also serves as a bag handle since it extends through both the front and rear wall of each bag. Since the bags are preferably rectangular the semi-lunar opening should be spaced from the upper edge of the bag by a sufficient distance to provide support for the bag and prevent tearing when the bag is filled with the type of articles which it is intended to carry.

Sufficient stiffness is imparted to the walls of the bags by co-extruding them to provide an inner layer of 50 to 95% HMW HDPE (high molecular weight, high density polyethylene) with a density of 0.945 to 0.965 and a melt index of 0.01 to 0.05. Coextruded with this inner wall is an outer wall of MLDPE (medium low density polyethylene) having a complimenting range of 50% to 5% with a density of 0.920 to 0.940 and a melt index of 0.4 to 0.6.

After coextrusion of the two layers the outer face of the MLDPE is subjected to corona treatment (45 dynes) to impart a desired amount of stickiness for printing purposes. Also when the outer walls are placed in contact with similar outer walls of an adjacent bag, particularly after having been subject to the pressure of the die which cuts the semi-lunar opening in the stacked bag blanks, the leading bag will initially tend to draw the front wall of the next ensuing bag outward to open the bag, further pulling of the first bag results in detachment of the rear wall of the first bag from the front wall of the next ensuing bag, thereby accomplishing self opening of the latter.

In the manufacturing process, after the coextruded tubing has been subjected to the corona treatment, printed and gusseted, when the bag blanks are cut before stacking, they are only sealed at one end. After the bags are stacked, the unsealed ends of the bags are subjected to a dye cutter which cuts out the semi-lunar handle and mounting hole.

A mounting rack for bags of the present invention requires only a single element, either all or a portion of which projects somewhat upwardly. Actually, a whole rack is unnecessary. All that is required is some means for supporting the mounting element, such as a base which could be attached to a vertical wall or side of a counter. It might, however, be desirable to provide some dispensing unit which, in addition to supporting the mounting element, could encompass the sides of the bag packs, or at least retain the upper corners of the bags of the stack in register. Any such rack, however, need not hold the bags in a vertical position but could be set at any convenient angle, e.g. 35 degrees to 75 degrees.

DESCRIPTION OF THE DRAWINGS

In the accompanying drawings,

FIG. 6 is a front elevation of the assembly shown in FIG. 5.

FIG. 7 is a front elevation showing corner hoods attached to and supported by the dispensing member.

FIG. 8 is a side elevation of the hood and dispensing member shown in FIG. 7.

FIG. 9 is a front elevation showing a dispensing member and hood carrying a stack of bags of the present invention.

DESCRIPTION OF THE PREFERRED EMBODIMENT

Figure 1:
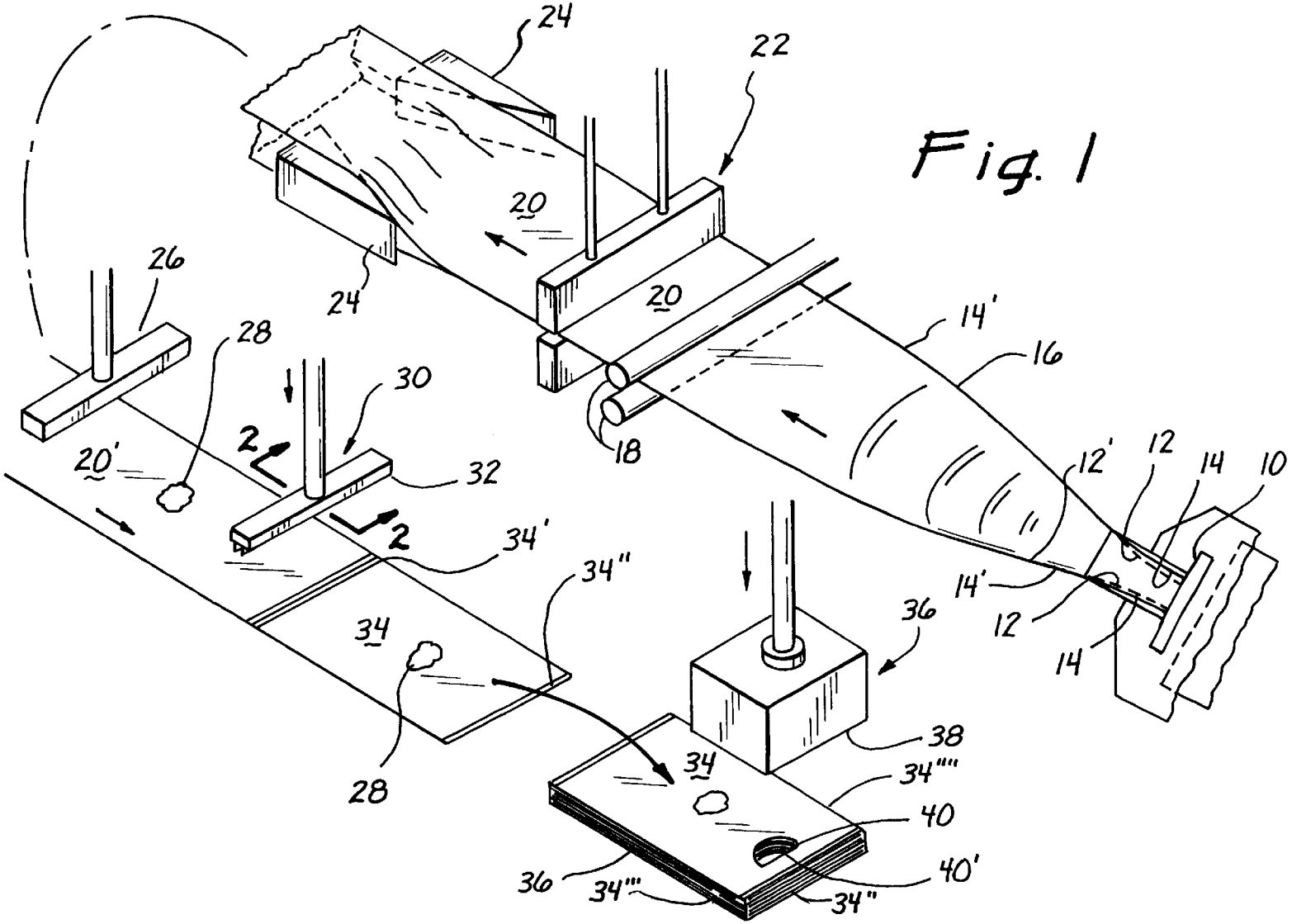
FIG. 1 is a perspective view partially schematic illustrating the method of manufacturing the plastic bags of the present invention.

Referring to FIG. 1, a co-extruder 10 conjointly discharges an inner high density polyethylene 12 within an outer tube of a medium low density polyethylene 14. After the co-extrusion has occurred, a single tube 16 is formed having an outer wall 14' of medium low density polyethylene with an inner wall 12' of HMW HDPE. Since it is an object to produce bags of a desired degree of stiffness, the resin which is utilized to produce the high density inner wall 16' may vary within the range of from 95% to 50% HMW HDPE with a density of 0.945 to 0.965, and a melt index of from 0.01 to 0.05. Correspondingly, the resin for the outer wall, preferably, may be an MLDPE which would complementary vary from 5% to 50% with a density of 0.920 to 0.940 and a melt index of 0.4 to 0.6.

Figure 2:
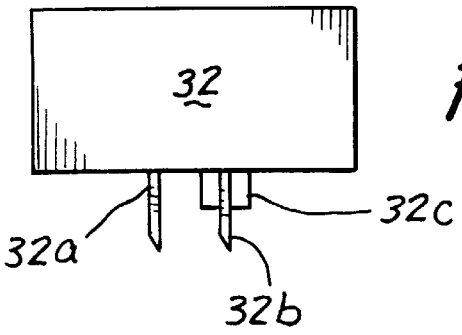
FIG. 2 is an enlarged section taken on the line 2—2 of FIG. 1.
Figure 3:
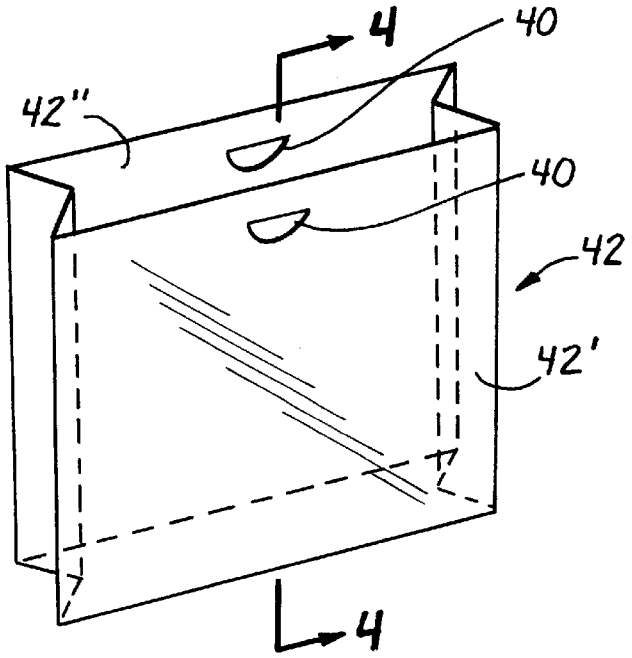
FIG. 3 is a perspective view of a plastic bag which results from the method illustrated in FIG. 1.
Figure 4:
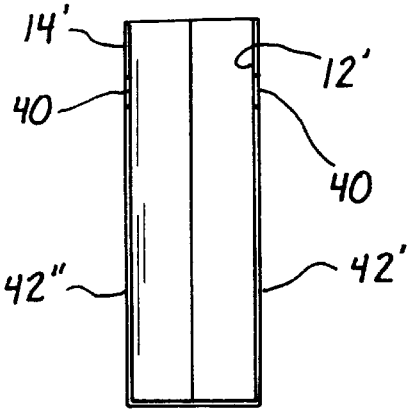
FIG. 4 is a section taken on the line 4—4 of FIG. 3.
Figure 5:
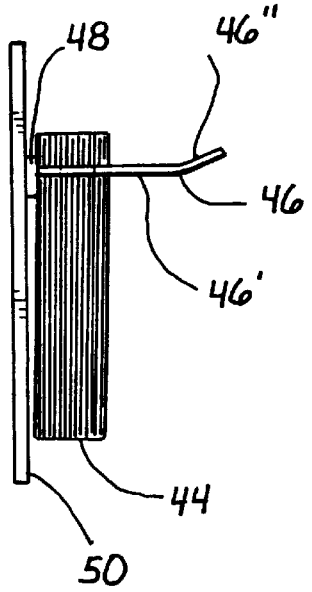
FIG. 5 is a side elevation showing a stack of bags of the present invention mounted on dispensing member.

The two co-extruded component walls 14' and 12' which form the tube 16 are initially passed through a pair of rollers 18 where the tube is flattened to the form shown at 20. Tube 20 is then moved through a corona treating station 22, following which the tube 20 may be subjected to printing at position 26 to provide wording or design 28. Following printing, the thus flattened, corona treated and printed tube is passed through gusseting station 24. Following gusseting, the tubing 20' passes a cutting station 30 where a reciprocating cutter 32, shown best in FIG. 2, is brought down onto the flattened tubing 20" to effect a double cut, the first of which, effected by its blade 32*a*, simply transversely severs the flattened tubing 20', while the second blade 32*b*, which carries a heating element 32*c*, both effects a cutting and a sealing along the cut line. Thereby, there is produced a blank 34 having a sealed bottom end 34' and an open upper end 34". Each of a selected number of blanks 34 is then deposited in a stack 35 in register with adjacent blanks 34. When a predetermined number of blanks 34 have been deposited to form the stack 35, a dye cutter 36 is brought down on the stack 35 with the blade (not shown) adapted to cut through the stack 35 and provide registering semi-lunar openings 40 intermediate the side edges 34'", 34"" of the blanks and with a rectilinear edge 40' of the opening 40 being parallel to the open ends 34"of the blanks 34. The result of the method thus described is a polyethylene handle bag 42 in the form shown in FIGS. 3 and 4 with a stiff inside wall 12' and a tacky outside wall 14'. The bags 42 thus formed would ordinarily be delivered to retailers or other users in boxed packs of 50 to 200, each of which bags 42 may be removably adhered to adjacent bags by virtue of the tackiness of the outside wall 14 of the front and back walls 42', 42", particularly after being subjected to the pressure of the dye cutter 38 as shown in FIG. 1.

To dispense bags from a thus formed pack 44, a supporting hanger member 46 may be provided. The member 46 may be secured by a base 48 to a wall or other horizontal surface 50 by an adhesive or screws, not shown. The member 46 may either be aligned partially upwardly from the base 48, or may project outwardly horizontally for a certain portion 46' of its extent and then angled upwardly at 46" for the remainder of its length. The member 46 is configured, preferably, with a flat upper surface 46"' and is of a lateral dimension at least slightly less than diameter of the semi-lunar openings 40 in the bag walls 42' and 42".

In an alternate embodiment of a support for a bag pack 44 there may be extended from the base 48 a plurality of struts 50 which may support retaining corner members 52. The corner members 52 serve to keep the bags 42 of the pack 44 in register after they have been placed on the support member 46.

In use, then, a pack 44 of bags 42 is placed on the support member 46 and when required for use by the retailer, since the outer walls 14' are of medium LDPE and have been subjected to corona treatment, and the pack of blanks 34, to the dye cutter 38, it will be found that there is sufficient adherence between the front wall of the first bag and the rear wall of the next ensuing bag so that, as the first bag is pulled off the support 46, the next ensuing bag will be at least partially opened to receive articles placed in the bag by the retailer. The degree of adherence may vary in accordance with the type and quality of MLDPE which is extruded to form the outer wall of the tube. The melt index values may be controlled during the process of forming the resins. The ranges herein specified have been found to be particularly suitable to accomplish the bag functions of the present invention.

What is claimed is:

1. A rectangular plastic bag formed of front and back walls secured to each other around their side and bottom edges to leave an opening between the top edges of the walls, each of the walls having a semi-lunar opening with a rectilinear upper edge of a predetermined extent disposed parallel to and spaced from the top edge of the wall and disposed intermediate of the side edges of the wall, the semi-lunar openings of the bag walls being adapted for hanging the bags on a support member in the form of a horizontal projection having a transverse planar surface of a dimension less than said predetermined extent of the rectilinear edge of the semi-lunar opening, said opening also serving to receive a user's hand for carrying the bag when the bag has been removed from the projection, each of said bag walls being formed of a co-extrusion of HMW HDPE to provide an inner wall of at least 50% of the total wall thickness, and of MLDPE of correspondingly less than 50% to constitute with HMW HDPE 100%, and to provide the outer wall, said outer wall having been treated to 45 dynes of corona treatment;

thereby, the co-extruded bag's inner wall provides a desired degree of stiffness to the bag as a function of the percentage of HMW HDPE of the total wall thickness to prevent tearing of the bag at the semi-lunar opening when used as a handle for a bag filled with articles, and the outer wall provides a degree of receptivity for printing and adhesiveness, as a function of the percentage of MLDPE of the total wall thickness, and for successive openings for bags carried on the support member for removal upon filling.

2. A stack of plastic bags, each as described in claim 1, and disposed in register with other bags, in combination with the support member, said member being secured to a base disposed in a vertical position, said member projecting outwardly from said base, said member having a cross section of such dimensions and shape as to be insertable through the semi-lunar openings in the registering plastic bags, whereby the stack of bags may be removably mounted on said member by inserting said member through the semi-lunar openings of the bags of the stack.

3. The combination as described in claim 2, wherein the base is disposed in a substantially vertical orientation and the support member projects substantially normally from the base for a predetermined portion of its extent, said member being angled upwardly for the remainder of its extent.

4. The combination as described in claim 2, wherein the back wall of the first bag of the stack in the area surrounding its semi-lunar opening is detachably adhered to the front wall of the next ensuing bag in the corresponding area surrounding its semi-lunar opening, thereby when the first bag is being pulled off the projecting member on which the first bag is mounted, the rear wall of the first bag will pull the front wall of the next ensuing bag forward on the projecting member to open the next ensuing bag to receive articles until further pulling of the rear wall of the first bag detaches itself from the front wall of the next ensuing bag.

5. The method of forming a stack of bags to be mounted upon a member projecting substantially normally from a substantially vertical surface, said member having a horizontal upper surface, a predetermined width and an upwardly extending extent, said method comprising the steps of:

A. Co-extruding MLDPE with HMW HDPE to form a tubing having an inner surface of at least 50% of the total wall thickness of HMW HDPE and an outer wall surface of MLDPE correspondingly less than 50% of the total wall thickness to produce with the HMW HDPE a 100% co-extruded combination;

B. Passing said tubing between a pair of rollers to flatten the tubing;

C. Subjecting said flattened tubing to corona treatment at 45 dynes;

D. Printing the thus corona treated tubing;

E. Subjecting the tubing to gusseting;

F. Cutting the tubing into predetermined lengths and simultaneously sealing the trailing edge of each cut length to form a series of blanks having sealed bottom edges and open top edges;

G. Depositing a predetermined number of blanks in register to form a stack of blanks;

H. Subjecting the stack of blanks to a dye cutter to cut an opening transversely through all of the walls of the stacked blanks, said openings being formed each with an upper edge parallel to and spaced from the top edge of a blank wall by a first predetermined distance and in a semi-lunar configuration extending below the upper edge of the opening, said opening being equidistant between the side edges of its blank wall.

6. A plastic bag as described in claim 1, wherein the HMW HDPE comprising the inner wall has a density within the range of 0.945 to 0.965 and a melt index in the range of 0.01 to 0.05, and the MLDPE comprising the outer wall has a density within the range of 0.920 to 0.940 and a melt index within the range of from 0.4 to 0.6.

* * * * *